US005363884A

United States Patent [19]

Migliorini et al.

[11] Patent Number: 5,363,884

[45] Date of Patent: Nov. 15, 1994

[54] SELECTION BAR DESIGN IN AN ELECTRONIC WARP SELECTOR

[75] Inventors: Pier L. Migliorini, Terranuova Bracciolini; Pier C. Molta, Prato; Giorgio Torelli, Pisa, all of Italy

[73] Assignee: Tecnotessile Centro Di Ricerche S.R.L., Prato, Italy

[21] Appl. No.: 16,693

[22] Filed: Feb. 11, 1993

[30] Foreign Application Priority Data

Feb. 12, 1992 [IT] Italy ..... F192A36

[51] Int. Cl.[5] ..... D03C 13/00

[52] U.S. Cl. ..... 139/455; 139/59

[58] Field of Search ..... 139/455, 59

[56] References Cited

U.S. PATENT DOCUMENTS 4,667,704 5/1987 Griffith ..... 139/455

4,739,806 4/1988 Palau et al. ..... 139/455

FOREIGN PATENT DOCUMENTS 288850 4/1991 Germany ..... 139/455

*Primary Examiner*—Andrew M. Falik

*Attorney, Agent, or Firm*—McGlew and Tuttle

[57] ABSTRACT

Apparatus for selecting and controlling the warp threads moving structure, one by one, in the operations of weaving preparation and of weaving. A plurality of pairs of selection bars are provided. The bars of each pair are provided with reciprocating lifting and lowering motions in opposition of phase to each other. Corresponding rods are received in each of the pairs of the selection bars for moving the warp threads. Corresponding devices for hooking the rods to the selection bars under the command of a control element. Corresponding electronic, logic and control circuits are provided for operating the hooking devices.

9 Claims, 5 Drawing Sheets

SELECTION BAR DESIGN IN AN ELECTRONIC WARP SELECTOR

FIELD OF THE INVENTION

The present invention refers to an apparatus for selecting and controlling the warp threads moving means, one by one, in the operations of weaving preparation and of weaving.

BACKGROUND OF THE INVENTION

It is known to those skilled in the textile field, that the fabric is formed by inserting the weft threads through the shed of the warp threads, the latter being provided with a control-operated reciprocating motion in a direction perpendicular to that of the weft.

Depending on the complexity of the pattern of the fabric to be made, the warp threads may be lifted either in groups, with the heddles system, or one by one with the jacquard system. With the jacquard system, which provides for far superior pattern possibilities, the motion of the lifters which reciprocate the warp threads takes place, at present, in two steps:

The first step is a selection carried out through a pattern formed on punched cardboards joined in a continuous chain, or on a continuous tape of punched paper;

The second step is the motion of the selected lifters which are reciprocted by power members called knives.

This fully mechnical system for the selection and the motion of the warp threads through the lifters has some performance limits and numerous drawbacks owing to the complexity and heterogeneity of the elements it is made up of. Among said drawbacks are a bulky and heavy mechanism which, in order to be operated, has to be mounted above the loom on a suitable and sturdy scaffold; a limited production speed owing both to the remarkable forces of inertia deriving from the reciprocting heavy masses, and to the time needed for carrying out the various selections and movements; a large use of non metal elements: cardboard or paper for the pattern, hemp or nylon ropes for the harnesses, and punched harness boards whith consequent problems arising from changes in size due to environment temperature and humidity; a long and complex preparation of patterns, especially when carried out on cardboards; a limited density of warp threads due to the impossibility of operating under safe conditions with holes too small in diameter and of reduced center distance.

Jacquard devices are known which overcome some of the above mentioned drawbacks and limitations by implementing alternative methods of lifters control with the use of electromagnetic and similar elements, one for every lifter: the electrical pulses to the individual electromagnets being delivered through a direct electronic reading of the pattern to be performed.

However, in these devices, the advantage of eliminating the preparation of the pattern on punched cardboard or paper is undone by the overall dimensions of the electromagnets and the energy consumption thereof.

SUMMARY AND OBJECTS OF THE INVENTION

The present invention seeks to eliminate the drawbacks and limitations existing in all the warp threads-moving jacquard systems currently in use.

This result has been achieved, according to the invention, by providing an apparatus with a plurality of selection bars: the bars of each pair being provided with reciprocating lifting and lowering motions in opposition of phase to each other; with corresponding rods being received in each of the pairs of selection bars for moving the warp threads; with control-operated devices for hooking the rods to corresponding selection bars; with electronic, logic and control circuits for operating the corresponding hooking devices; with actuation means for the lifting and lowering of the individual selection bars.

The advantages achieved through the present invention lie essentially in that the selection bars are able to transmit the motion to the warp threads when these are placed either above or below the weaving plane of the loom; that the assembly of the elements required for the selection and control of the warp threads is compact, since it is fully incorporated in the bars and ensures, therefore, a density up to 1920 stitches over 620 $cm^2$; that it provides for a reduced number of electrical leads for the selection and control of the warp threads as the logic circuits for the prearrangement of the operating controls of the individual hooking levers are located inside the bars; that it is possible to operate with a production speed higher than that currently reached because both of the limited weight of the reciprocating masses and of the shorter time required for actuating the various selections and motions; that provision is made for suppressing the time for preparing the pattern on paper, as the pattern is directly analyzed by a suitable electronic system and converted into pulses delivered to the various logic and control circuits of the hooking levers; that the means for hooking the rods to the selection bars allow for a significant reduction of the dimensions and a simplification of the whole.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1:
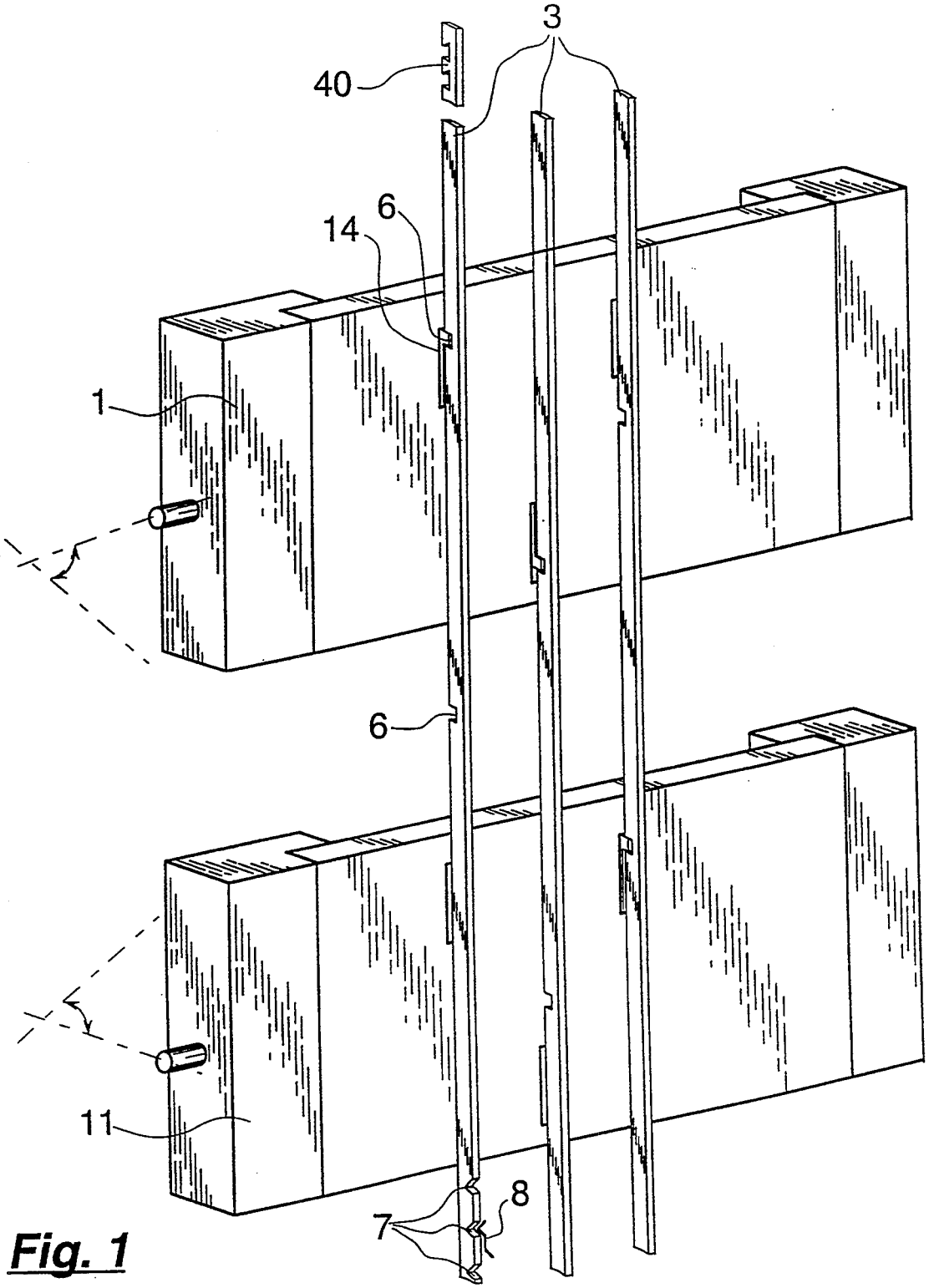
FIG. 1 shows a front view of a pair of selection bars and some of the rods placed thereon.
Figure 2:
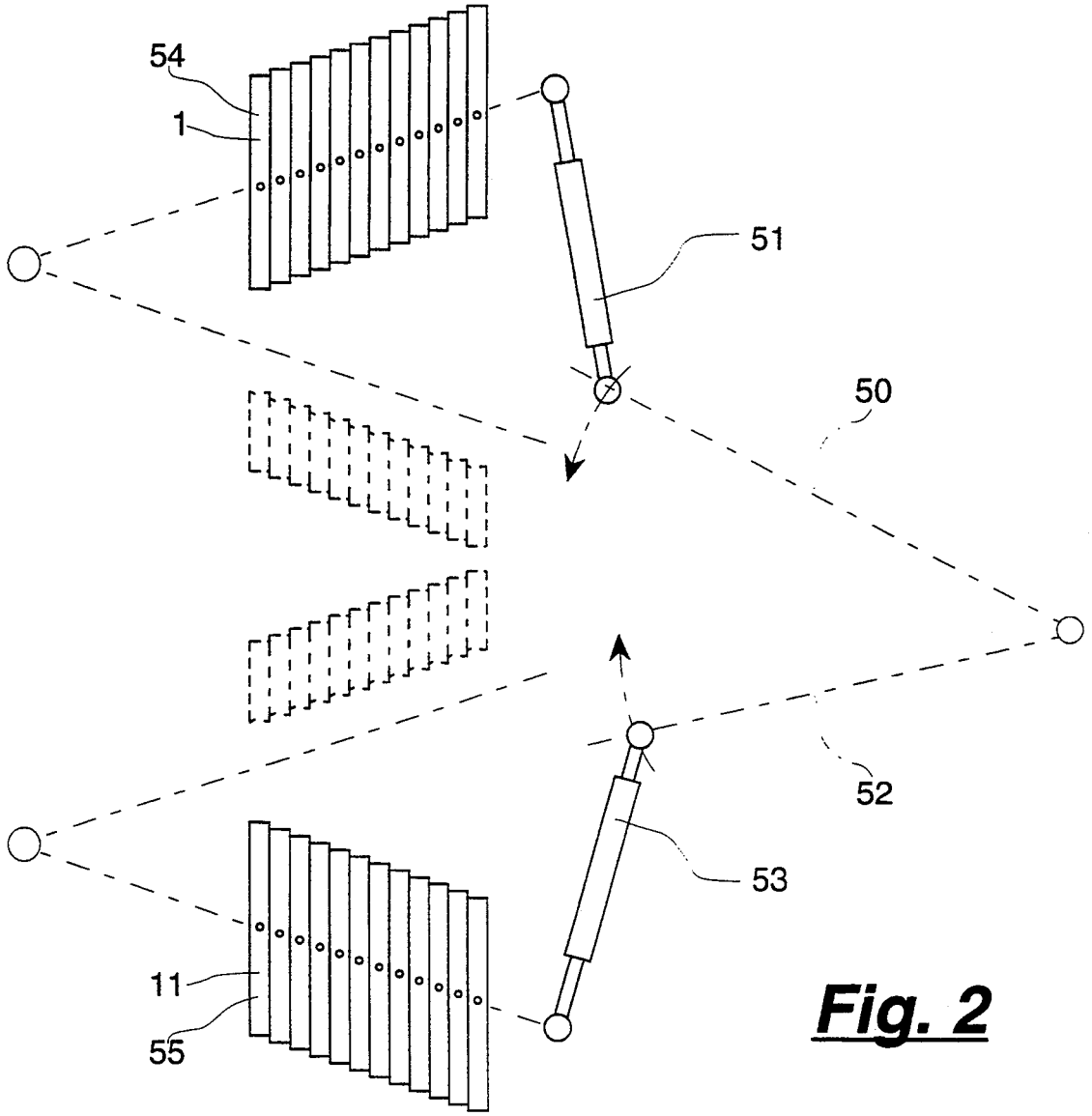
FIG. 2 shows a schematic side view of the two packs of selection bars and the levers for the actuation thereof.
Figure 3:
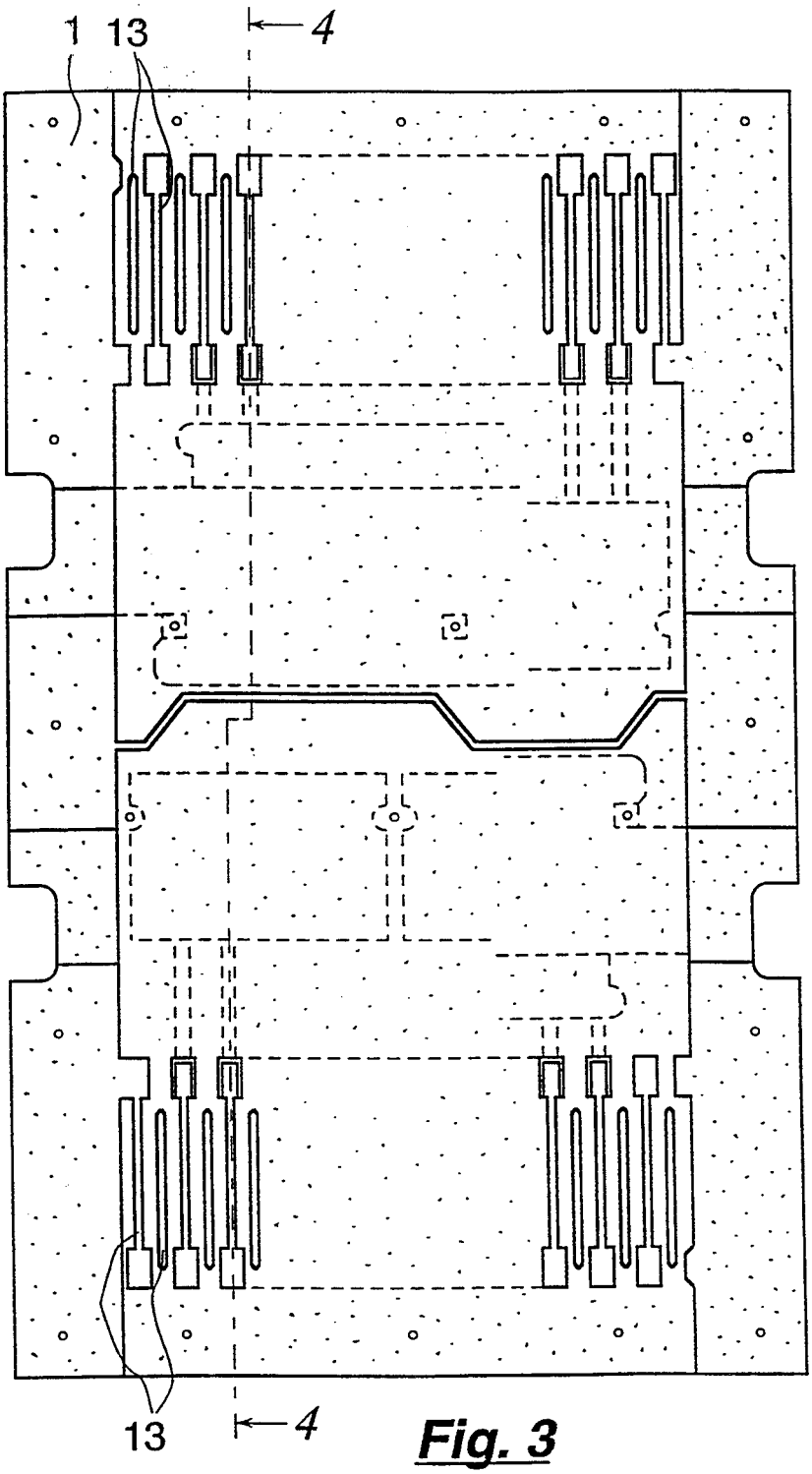
FIG. 3 shows a front view of a selection bar.

Reduced to its basic structure and reference being made to the attached drawings, an apparatus for moving the warp threads, according to the invention, is made up of:

a plurality of selection bars (twelve in the example), each pair consisting of an upper bar 1 and a lower bar 11, the bars being substantially identical.

Each of bars 1,11 is a rectangular prismatic element of non-magnetic material, preferably an alluminium alloy for reasons of lightness, inside which the seats 18 of control members for operating the hooking of rods 3 to the bar, and the seats 19 of the relevant electronic, logic and power circuits are formed. Said element is closed on the front and rear sides by two plates of non-magnetic material, preferably phosphor bronze.

Figure 4:
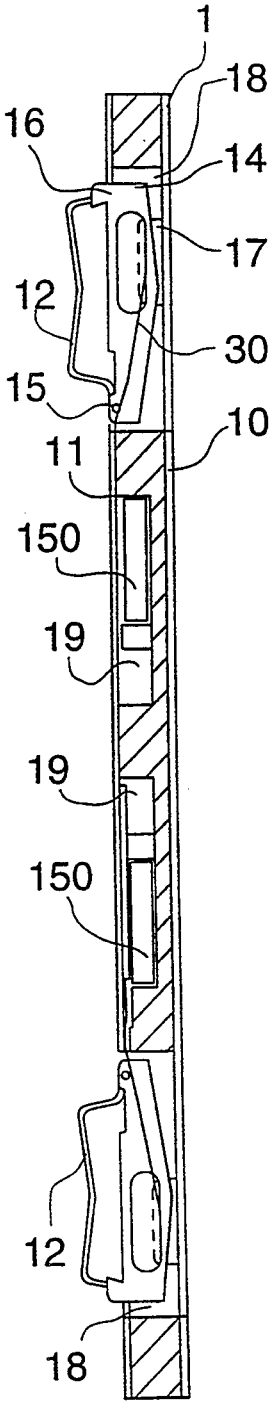
FIG. 4 shows a cross-section of FIG. 3 taken on line A—A.
Figure 5A:
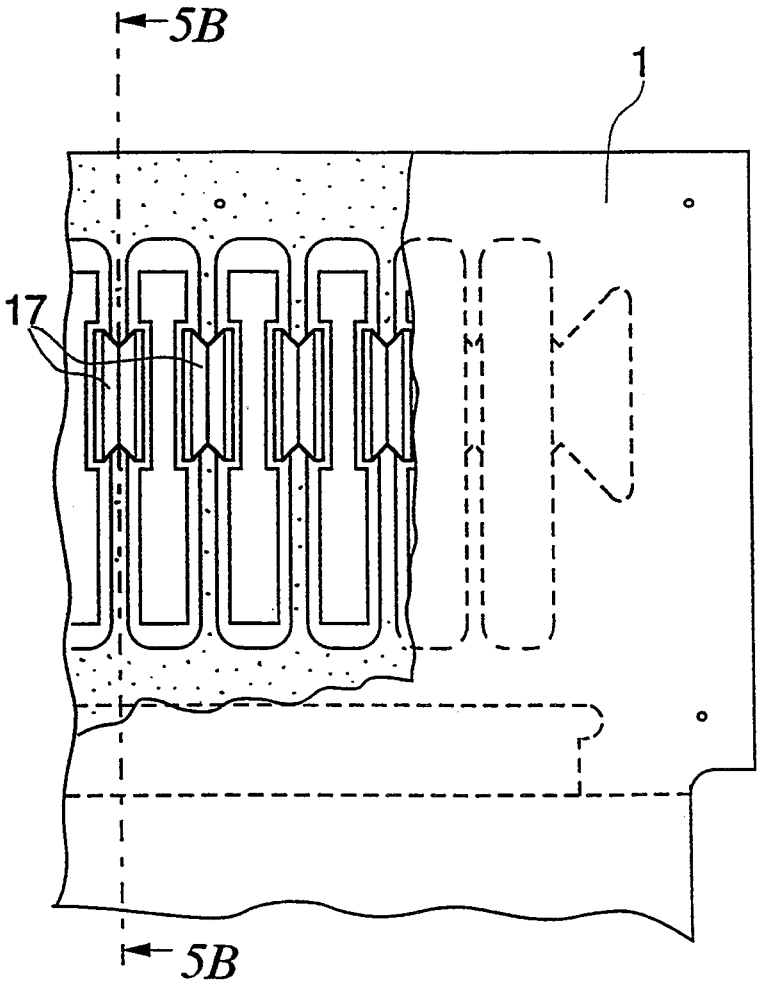
FIG. 5A shows a detail of the system for hooking the rod to the selection bars.
Figure 5B:
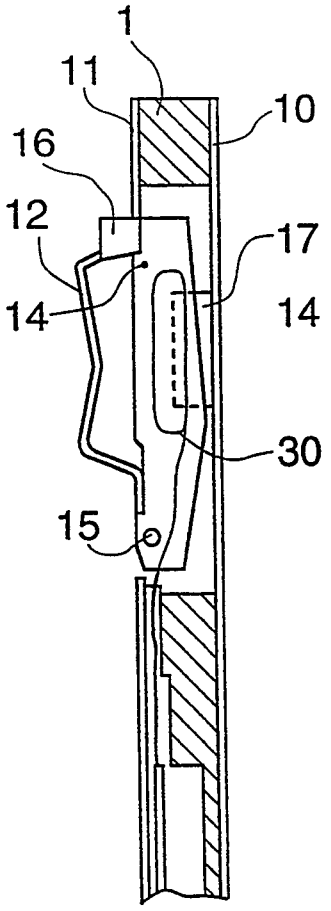
FIG. 5B shows a section view of FIG. 5A taken on line B—B.

Stamped out in the upper and lower sides of the rear plate 10 are two shaped projections 12 (see FIG. 4) provided with parallel slits 13 wherein the rods 3 can slide.

Each of said bars 1,11 is identically shaped with respect to its central longitudinal line, in the upper and lower part thereof, the parallel slits 13 of the upper part having an interspace of 3 mm and being lined up with those of the lower part;

a plurality of rods 3 for each pair of bars 1,11 (a total of 1920 in the illustrated example) for moving the warp threads.

Each rod 3, made of a thin steel band, has on its top end an attachment 40 for securing a lifter to which the warp thread is hooked. Also formed in each rod are two suitably shaped cavities, each of which is intended to engage, under control (via a command), the terminal heel 16 of the lever 14 for hooking either the upper bar 1 or the lower bar 11, respectively.

The lower end of the rod 3 is provided with three V-shaped notches 7 provided for engaging a retaining spring 8; the engagement within the lowermost notch or within either one of the other notches allows fixing the rod either in an inoperative position, for the hooking of the warp thread; or in a lifting or lowering work position;

A plurality of levers 14 (160 in the example) are provided for hooking the rods 3 on each bar. Half of the levers 14 are assigned to the upper bars and the other half are assigned to the lower bars.

Incorporated within each hooking lever 14 is a coil 30 within which an electric current is made to flow under control (via a command), said current causing the same lever to move to a hooking or releasing position according to its flow direction.

The levers 14, whose shape is similar to a thin paralleliped, are individually located in each seat 18 and made to oscillate about a pivot 15 for ensuring the blocking of the relevant rods 3 when the lever heel 16 enters one of the rod cavities 6;

a plurality of magnets 17 (numbering to 162 in the example) of paralleliped shape, half of which provided in the upper part of each bar and the other half in the lower part thereof.

The said magnets 17, which are fixed in the seats 18 of each bar and located side by side with constant pitch, generate a magnetic field of constant direction and strength, in the space between the opposing surfaces, within which field each of levers 14 may freely move, in one direction or the other when electric current is made to flow in the coil 30.

When a current flows in the turns of the coil 30, an electrodynamic force is produced given by the formula $F=BLI$, wherein B is the field strength, L is the total length of the leads immersed in the field, and I is the intensity of the flowing current.

The force F has a direction perpendicular to the plane in which the lines of magnetic flux and the leads run. Depending on the current direction, the force F pushes the lever 14 so as to insert the heel 16 thereof into the cavity 6 of the rod 3, or the force F pulls the same lever to disengage it.

Once the motion is obtained through a suitable intensity of current, the position stability is ensured by maintaining a concordant intensity of reduced value.

A plurality of electronic, logic control and power-setting circuits 150 (160 in the example) are provided for operating the mobile coils 30 on each bar, half of which circuits are provided in the upper part and the other half in the lower part thereof. Said circuits being located within the seats 19 of each bar.

A plurality of levers 50,51 and 52,53 are provided for operating the two packs of bars 54,55, the upper one (54) and lower one (55), the first holding the bars 1 and the second the bars 11 of the pairs. Said levers allowing said packs of bars to be reciprocated with a lifting and lowering motion in opposition of phase between them.

Figures 6A, 6B, 6C:
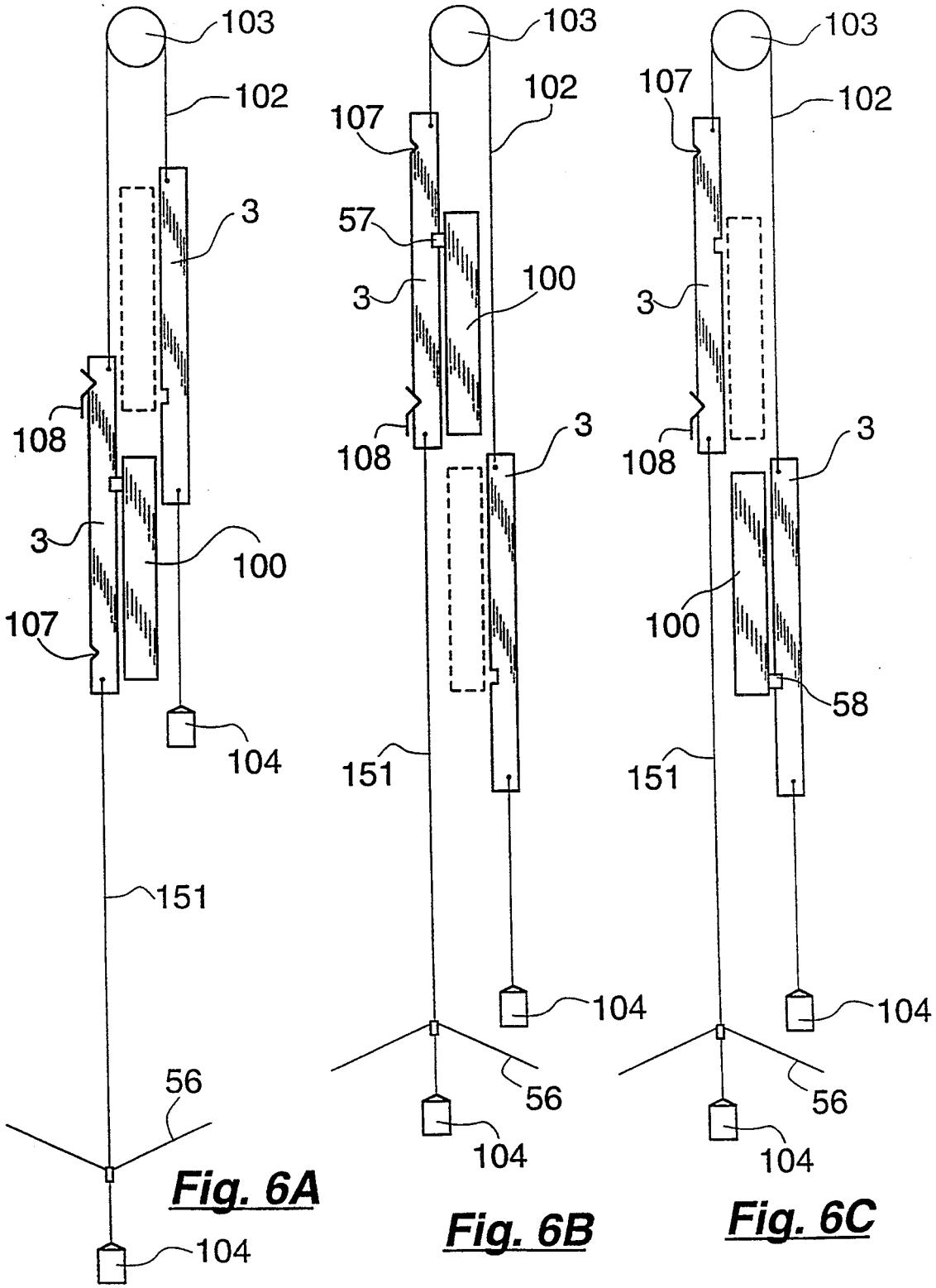
FIG. 6A shows the detail of a selection rod and the thread in lowered position for the use of the apparatus on jacquard looms.
FIG. 6B shows the selection rod of FIG. 6A as it is moved upwards with the thread in lifted position.
FIG. 6C shows the selection rod of FIG. 6A in its downwardly movement and with the thread in lifted position.

According to a further embodiment for use to advantage in the jacquard looms, the apparatus may take up the constructional shape shown in FIGS. 6A, 6B and 6C.

Each selection bar 100, which is subjected to a vertical reciprocating motion of lifting and lowering, holds all the elements previously described for the bar 1, that is, the rods 3, the hooking devices and the electronic, logic and control circuits.

The selection bars 100 amount to a number necessary to move all the warp threas of the loom.

The hooking devices and the electronic circuits which, in the case of bar 1, are so distributed that half of them are in the upper part and the other half in the lower part of the same front face, in the case of bar 100 half of them are in the upper part of the front face and half in the lower part of the rear face.

Each warp thread 56 is actuated, through the attachment 15 1, by a pair of rods 3 one of them being received in the front face and the other in the rear face of the bar 100, the same rods being connected between them via a flexible element 102 and a pulley 103.

In this way, it is possible to achieve the lifting of the warp threads also upon the phase of lowering the bar 100 by blocking the rods 3 of the rear face. The rods 3 are balanced by counterweights 104 and blocked into the high or low work positions by retaining springs 108 engaged within V-profile notches 107.

The operation is as follows.

Since the operation is identical for all the pairs of selection bars, the description will refer to the work positions of the elements of one pair listed above.

The bar 1 of the upper pack 54 and the bar 11 of the lower pack 55 lie on a same vertical plane, and the slits 13 of each row (respectively two on bar 1 and two on bar 11) are lined up with each other so that each one of the two rods 3 housed therein has four guiding points in correspondence of the slits.

The rods 3, being referred to as even or odd depending on their position on the bar, starting from the left, are vertically disposed orthogonally to the rows of slits 13.

The rods 3 of odd order may be fixed either to the bar 1 by inserting the heel 16 of lever 14 housed within the cavity 18 of bar 1 into the cavity 6, or to the bar 11 by inserting the heel 16 of the lever housed within the cavity 18 of bar 1 into the cavity 6.

The rods 3 of even order may be fixed either to the bar 1 by inserting the heel 16 of the lever 14 housed within the cavity 18 of bar 1 into the cavity 6, or to the bar 11 by inserting the heel 16 of the lever 14 received in the seat 18 of bar 11 into the cavity 6.

Since the bars 1,1 are provided with reciprocating, that is, lifting and lowering motions in opposition of phase between them, the rods 3 of odd order which, for example, have to be lifted, will be fixed either to the bar 1 or respectively to the bar 11, depending on which of the two bars is in the lift position when giving the command.

Based on the motion of the warp threads through the rods 3, the actuation of each one of the relevant levers 14 is predisposed through the corresponding electronic logic circuits located in the seats 19, and is carried out by the electronic power circuits also located in said seats 19.

The levers 14 are held in the engagement and disengagement position by causing a current—of an intensity less than that necessary for the actuation thereof—to flow inside the coil 30.

Practically, all the construction details may vary in any equivalent way as far as the form, dimensions, elements disposition, nature of the used materials are concerned, without nevertheless departing from the scope of the adopted solution idea and, thereby, remaining within the limits of the protection granted to the present patent for industrial invention.

We claim:

1. Apparatus for selecting and controlling warp thread moving elements in weaving preparation and weaving operations, comprising:

a plurality of pairs of selection bars;

means for moving the bars of each of said pairs with a reciprocating lifting and lowering motion with bars of each pair moving in opposition of phase to each other;

rods received in each of said pairs of selection bars for moving warp threads;

hooking elements for hooking the rods to the selection bars;

electronic logic and control circuit means for operating said hooking devices, each of said selection bars receiving said rods for moving the warp threads and supporting said hooking elements and said electronic logic and control circuit means.

2. Apparatus according to either claim 1, wherein said rods of each pair of selection bars are connected in an upper part by a flexible element with a pulley.

3. Apparatus for selecting and controlling warp thread moving elements in weaving preparation and weaving operations, comprising:

a plurality of pairs of selection bars;

means for moving the bars of cacti of said pairs with a reciprocating lifting and lowering motion with bars of each pair moving in opposition of phase to each other;

rods received in each of said pairs of selection bars for moving warp threads;

hooking elements for hooking tile rods to the selection bars;

electronic logic and control circuit means for operating said hooking devices, said selection bars being substantially identical with each pair of selection bars lying in a vertical plane with one selection bar located above another selection bar of each pair and each selection bar including slits in alignment with each other along vertical and equidistant lines.

4. Apparatus according to either claim 1 or claim 3, wherein said selection bars of each pair of selection bars are joined together into two packs, including an upper pack comprised of a plurality of upper selection bars and a lower pack comprised of a plurality of lower selection bars.

5. Apparatus for selecting and controlling warp thread moving elements in weaving preparation and weaving operations, comprising:

a plurality of pairs of selection bars:

means for moving the bars of each of said pairs with a reciprocating lifting and lowering motion with bars of each pair moving in opposition of phase to each other;

rods received in each of said pairs of selection bars for moving warp threads;

hooking elements for hooking the rods to the selection bars;

electronic logic anti control circuit means for operating said hooking devices, each rod being formed of a thin steel band having a top end with an attachment for securing a lifter, to which a corresponding warp thread may be hooked, each of said rods having two cavities, each of said cavities for engaging a terminal heel of a lever for hooking an upper bar of a pair of selection bars or a lower bar of a pair of selection bars, said rod being provided with a lower part having three v-shaped notches for engaging a retaining spring in a rod inoperative position for hooking of the warp thread or for lowering the rod in a work position.

6. Apparatus for selecting and controlling warp thread moving elements in weaving preparation and weaving operations, comprising:

a plurality of pairs of selection bars;

means for moving the bars of each of said pairs with a reciprocating lifting and lowering motion with bars of each pair moving in opposition of phase to each other;

rods received in each of said pairs of selection bars for moving warp threads;

hooking elements for hooking the rods to the selection bars each of said hooking elements includes a lever and a coil movable about a pivot, said hooking element being supported by an associated one of said selection bars, said lever having a heel for blocking the rod to the associated bar upon insertion of the heel into a corresponding cavity of the rod; and electronic logic and control circuit means for operating said hooking elements.

7. Apparatus according to claim 6, wherein said hooking element includes an electrical coil and a plurality of magnets anchored within opposite seats of each of said bars, said magnets generating a magnetic field in a direction parallel to an axis of said coil so as to cause said lever to oscillate when electrical current flows in said coil turns.

8. Apparatus according to claim 6 wherein a position of engagement and disengagement of said heel of said lever into and out of said cavities is maintained by causing electrical current to flow in said coil, said electrical current having an intensity less than that need to move said lever from one position to another position.

9. Apparatus according to claim 6, wherein said electronic logic and control circuit means includes a number of electronic logic and control circuits equal to a number of coils, said electronic logic and control circuits being located close to a corresponding coil within suitable seats of said bars for operating the oscillation of said levers.

* * * * *